United States Patent [19]

Gibson

[11] Patent Number: 4,875,292

[45] Date of Patent: Oct. 24, 1989

[54] CONTROL SYSTEM FOR EARTH BORING TOOL

[75] Inventor: Paul N. Gibson, Saluda, S.C.

[73] Assignee: Ronald L. McFarlane, Buffalo Grove, Ill.

[21] Appl. No.: 849,537

[22] Filed: Apr. 8, 1986

[51] Int. Cl.[4] ..... E21B 47/02

[52] U.S. Cl. ..... 33/304; 175/45

[58] Field of Search ..... 33/304, 306, 307, 310, 33/312, 302; 175/19, 24, 26, 40, 44, 45, 50, 73, 19, 61

[56] References Cited

U.S. PATENT DOCUMENTS

| | | | |
|---|---|---|---|
| 3,229,375 | 1/1966 | Crake et al. | 175/45 |
| 3,857,449 | 12/1974 | Kimura | 33/304 |
| 3,964,553 | 6/1976 | Basham et al. | 33/304 |
| 4,407,374 | 10/1983 | Wallussek et al. | 175/61 |

*Primary Examiner*—Willis Little

*Attorney, Agent, or Firm*—Foley & Lardner

[57] ABSTRACT

An earth boring tool control system for monitoring the spatial orientation of a remote boring tool (10) and adjusting the path thereof to maintain a predetermined course (22), is comprised of a vertical position detector (26) for determining the elevation of the tool relative to a desired course, including a sensor head member (32) in operative engagement with the tool for establishing a pressure head of fluid characteristic of the vertical disposition of the tool, a pressure sensor member (50) for sensing a differential pressure in response to variations in the height of the pressure head, and a fluid circuit (40, 44) communicating between the sensor head member and the pressure sensor member for transmitting any pressure variations to the sensor member; a horizontal position detector (28) for determining the azimuth of the tool relative to the course, including Hall generators (80, 82) in operative engagement with the tool for developing normalized output signals (90, 92) proportional to deviations in an ambient magnetic field characteristic of the horizontal disposition of the tool; and path correction members (30) secured to the tool for adjusting its route relative to the course, including hydraulically actuated deflection members (114) for bearing against the bore hole created by the tool.

19 Claims, 3 Drawing Sheets

Fig. 1
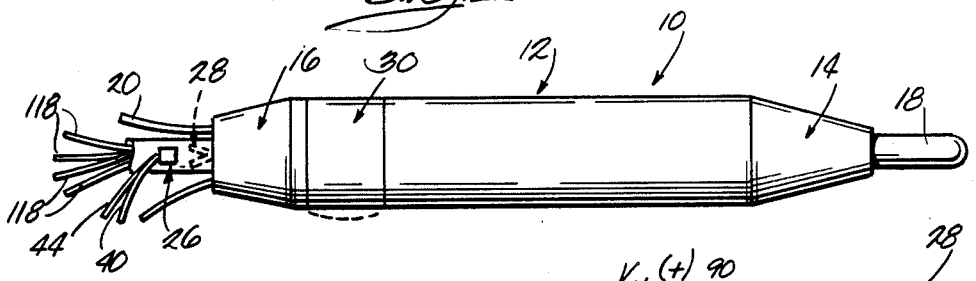
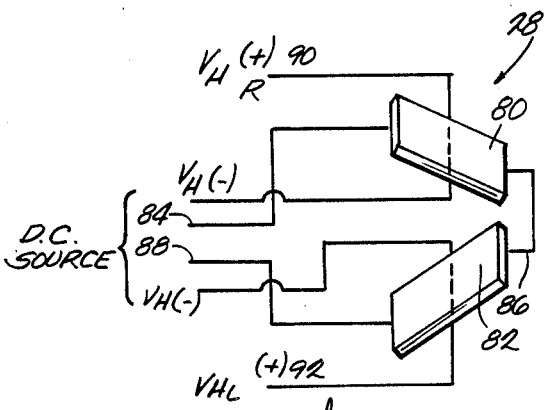
Fig. 4
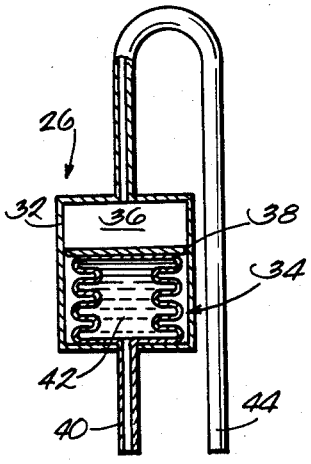
Fig. 2
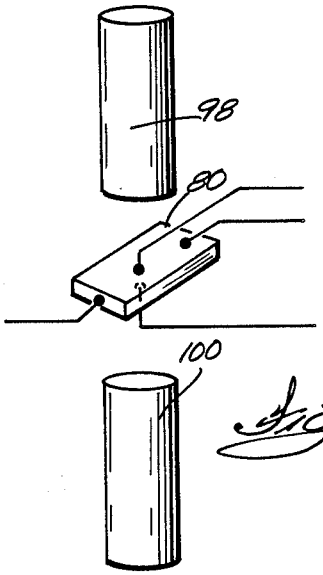
Fig. 5

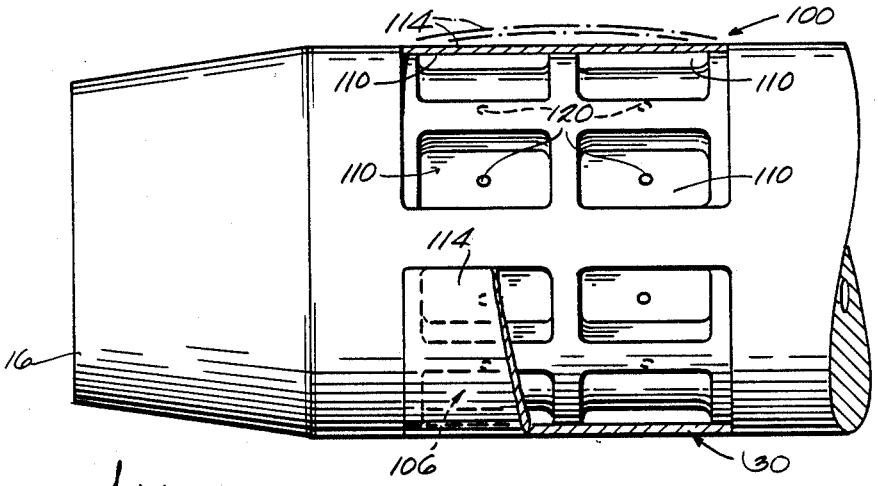
Fig. 6
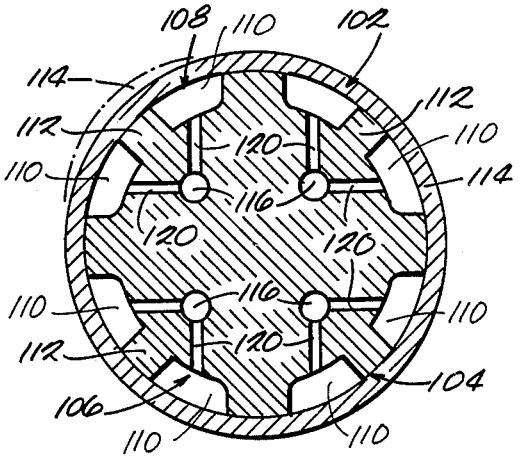
Fig. 7
Fig. 8
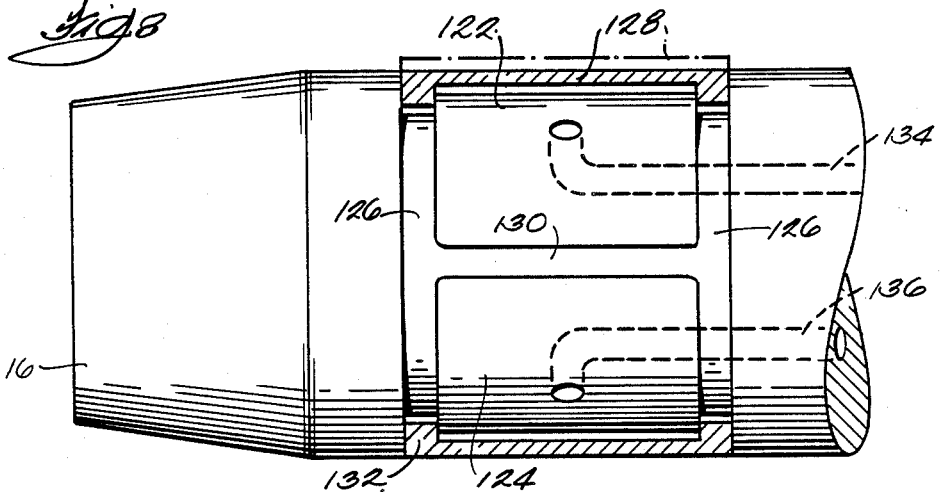

CONTROL SYSTEM FOR EARTH BORING TOOL

TECHNICAL FIELD

The present invention relates, generally, to control systems for monitoring the spatial orientation of a remote earth boring tool and adjusting its path to maintain a predetermined course, and more especially to a control and monitoring system for a microboring tool whereby both vertical and horizontal positions are monitored and corrections are made to ensure the device maintains a desired course.

DESCRIPTION OF THE BACKGROUND ART

Earth boring or tunneling has become a popular and important technique for excavation, particularly that associated with the laying of underground cable or pipe. Urban growth and exploding technology have both contributed to the need for subterranean excavation; for example, the laying of additional or replacement sewer lines in a city or the installation of telephone or other communication lines is becoming increasingly necessary in most urban centers. Yet, it is neither convenient nor efficient to perform this excavation from above the ground, tearing up existing roadways, disrupting traffic flow, and paying the enormous costs associated with these endeavors. Rather, underground boring or tunneling has emerged as a viable and highly desirable alternative.

The allure of subterranean boring to the contrary notwithstanding, these approaches have to date been severely limited in many ways. Most notably, the tendency for the boring tools to move off course or otherwise wander erratically has handicapped broad applicability or wide acceptability of this approach. Thus, boring 20 or 30 feet across a roadway course has been found to be an efficient application of this technology; however, boring several hundred feet along a roadway course has heretofore been found to be too great a challenge for existing technology. As the tool, whether auger or impact type, proceeds along its earthen path, it is subject to diversion from a desired or predetermined course as the device strikes rocks or other obstructions, moves through zones of differing soil density, perhaps traverses a path through or beneath the watertable, or encounters similar underground conditions. Sometimes these deviations can be acceptable, particularly where the course is short. Where a tool is required to progress several hundreds of feet, however, even small angular deflections can amount to substantial departures. In these latter cases, it is not simply an inconvenience of missing the mark alone which plagues the operator; sometimes the tool itself can be lost and require major excavation to retrieve it or suffer its forfeiture.

Scores of proposals have surfaced to monitor the vertical disposition of a boring or tunneling tool. In instances where large auger-type tunneling tools are utilized, creating caverneous bores through the earth, transits or other conventional line-of-sight procedures have been adopted with reasonable success. More recently the availability of laser technology has improved the accuracy of these techniques. Workable as they are, however, these approaches begin to falter as the diameter of the bore or tunnel moves down to the scale of about two feet or less, typically considered the realm of microboring.

The present inventor has successfully proposed an elevation monitor for measuring the percent of grade of an earth boring tool. Referring specifically to U.S. Pat. No. 4,438,820, the system includes, inter alia, a grade sensor having a reservoir containing a liquid medium at a predetermined level, a light source for transmitting light through the liquid and an opposed light detector for determining the intensity of light transmitted through the liquid. As the tool changes orientation the level of fluid changes proportionately as well. In turn the transmittance of light through the liquid becomes greater or lesser, the detection of which is a direct indication of the pitch or grade of the tool. That system further includes means for correcting the path of the boring apparatus in order to maintain it on a predetermined desirable course, in the nature of skiis or runners.

Others have suggested the use of fluids such as water to establish a gauge for measuring elevation, relying on the principle that the liquid will seek a common level within an open circuit. Exemplary of that approach is the device disclosed in U.S. Pat. Nos. 3,851,716 and 3,939,926. In those cases a fluid circuit, including a sensing member carried on the casing of an auger, is charged with water through a series of valves. The sensor is placed in fluid communication with a gauge centered at or about a reference level along the path of interest. Venting the system (i.e., bleeding off an excess fluid head) establishes a point of reference at the sensor while the level of fluid in the gauge conforms to that level simply as a matter of fundamental physics. In turn, the operator may observe the rise and fall (within rather confined limits) of the fluid column and hence, indirectly, the rise and fall of the auger itself.

Representative of other systems perhaps adaptable to this same end are those disclosed in U.S. Pat. Nos. 3,657,551, 4,129,852, and 4,154,000. While these devices are not necessarily disclosed to be useful in this particular environment, the same generally relate to slope indicators of various designs to which general reference is made for the sake of completeness.

While considerable attention has been paid to the monitoring of vertical disposition of a boring tool, few meaningful advances have taken place respecting the detection of horizontal deviations of a boring member from a predetermined or desired path. The complexity of that objective has, to date, virtually precluded meaningful, economically efficient approaches.

One proposal which has been noted with more than casual interest by those in the field has been advanced by the National Gas Research Institute. A boring tool is provided with a tightly wound wire coil which receives low frequency current, establishing a magnetic field centered about the tool. A receptive or detector coil is disposed in the pit at the entrance to the bore hole, this coil being in the shape of a "t" to present both vertical and horizontal receiving arms. The detector coil is thought to be able of detecting the field emanating from the moving boring tool at a range of up to about 100 feet. With the strength of the field falling off in relationship to an inverse square law, however, one can appreciate the enormous power requirement this approach necessitates. To date it has not received the kind of acclaim in the field that forebodes a promising development of this technology; nonetheless, it remains the most viable of known techniques to monitor horizontal disposition of a boring tool.

Monitoring the spatial orientation of a remote boring tool is a worthwhile endeavor at least to the extent that it allow an operator to locate a tool should it stray from a predetermined course without the need for major excavation. Better, however, is the ability to make corrections to the path of a moving tool in order to maintain it on the desired course in response to the detected deviations one may ascertain. Again, in the realm of the large tunneling devices, the ability to detect and then correct path departures is a relatively straightforward task. Note, for example, the approaches suggested in U.S. Pat. No. 4,042,046, with which one may profitably compare, for example, the aforementioned '716 and '926 patents as well as U.S. Pat. No. 2,946,578.

Moving to the smaller scale or microboring tools, the problem is exacerbated by the reduced sizes involved. The present inventor's aforementioned '820 patent discloses a ski arrangement of members pivotably connected to the boring casing and operable to guide the same by exerting a pressure against the earthen bore hole. Other approaches to this problem of steerage of microboring tools have not been forthcoming.

In view of the increasing importance of earth boring in general and microboring in particular, the art has not advanced concomitantly in the field of monitoring and controlling such devices over long courses such as those of 100 feet or more. The need thus exists for improved vertical and horizontal monitoring systems to detect spatial orientation of the boring tool as it traverses its path and for ascertaining deviations in that path from a predetermined or desired course. A need likewise exists for guidance mechanisms to take full advantage of the ability to monitor the path of a moving boring tool accurately and make suitable corrections to ensure the tool maintains a desired, predetermined course.

SUMMARY OF THE INVENTION

The present invention advantageously provides an improved control and monitoring system for an earth boring tool, especially a microboring tool. The present invention is highly desirable for its ability to monitor accurately the vertical and horizontal positions of the boring tool. The monitoring members of the present invention are remarkable for an elegance of simplicity, minimizing the probabilities of failure in the field, providing a high degree of reliability and freedom from complex maintenance, while maintaining a comparatively low cost thus improving the range of applicability of the invention to many settings. The present invention is further noteworthy for its integrated capability of adjusting the path of the moving microboring tool over a course of several hundred feet, if need be, while maintaining a high degree of accuracy in both of its monitoring functions. The present invention is seen to be accurate to within about one inch over 100 feet.

The foregoing advantages are realized, in one aspect of the present invention, by an earth boring tool control system for monitoring the spatial orientation of a remote boring tool and for adjusting its path to maintain a predetermined course, comprising a vertical position detector means for determining the elevation of a moving tool relative to the desired course, including a sensor head member in operative engagement with the tool in which is established a pressure head of fluid characteristic of the elevation of the tool, pressure sensor means for sensing a differential pressure in response to variations in the height of the pressure head, and a fluid circuit communicating between the head member and the sensor means for transmitting any pressure variations to the latter; a horizontal position detector means for determining the azimuth of the tool relative to the desired course, including Hall generator means in operative engagement with the tool for developing normalized output signals proportional to deviations in an ambient magnetic field characteristic of the horizontal location of the tool; and, path correction means secured to the tool for adjusting its route relative to the course, including hydraulically actuated deflection means for bearing against the bore hole created by the tool as it moves along its path.

The sensor head member of the vertical detector is most preferably comprised of a fluid bellows enveloped in a sealed container with a first fluid port leading from the bellows and a second fluid port leading from the chamber. The fluid circuit is comprised of flexible tubing providing communication between the sensor head member and a pressure sensor likewise having a pair of fluid ports. One of the legs of the fluid circuit, and preferably that associated with the interior of the bellows, is charged with a liquid such as water or oil, while the other side of the circuit provides an air passage. The fluid circuit is a closed circuit and the two legs, liquid and air, are isolated across the sensor, precluding communication between them. The pressure sensor most preferably includes a pressure transducer having a high degree of resolution for detecting pressure differential established between the two legs of the fluid circuit. The output of the transducer is advantageously applied to a balanced circuit, such as an instrumentation op amp circuit, for discriminating departures from the established reference or norm in either of the positive or negative directions. A gauge or suitable digital display is most preferably associated with the comparator in order to present to the operator a visual indication of vertical deviation of the boring tool. By judicious selection of components, accuracies to within tenths of inches may be achieved.

The horizontal position detector is comprised of means for sensing variations in a localized magnetic field and preferably includes a Hall generator, making good use of the uniformity of the earth's magnetic field throughout the layer of the crust in which boring customarily occurs. Most preferably, two Hall effect generators are associated geometrically in a right angle configuration, disposed to be 180 degrees out of phase electromagnetically whereby a magnetic resolver configuration is achieved. Alternatively, a single, three-axis orthogonal generator may be used. Irrespectively, with the tool initially oriented along the desired path the resolver may be normalized to the flux constituting the earth's magnetic field. Deviations both left and right are detected by the magnetic resolver, with the Hall generator providing signals as the orientation of the Hall devices changes relative to the orientation of the lines of magnetic flux, the two signals in the preferred embodiment tending to create a reinforced output due to the 180 degree phase relationship. In instances where the boring tool is fabricated from a material which is highly magnetically permeable, the Hall generators may be encapsulated therein with the tool itself functioning as a magnetic susceptor to concentrate the flux; where the tool is not fabricated from highly magnetically permeable material, it has been determined that the incorporation of ferrite rods to concentrate the magnetic flux is highly advantageous. Regardless, deviations from the established orientation yield normalized output signals proportional to the change in the ambient magnetic field characteristics, indicative of alterations in the horizontal disposition of the tool. These output signals are applied to a simple comparator circuit, are processed and presented for operator observation via a suitable display.

The control system of the present invention further incorporates a path correction means to take full advantage of the data generated by both the vertical and horizontal position detectors. In this manner the path of the tool may be adjusted to maintain it on the desired course. Preferably, the path correction means include hydraulically actuated deflections members for bearing against the bore hole created by the tool. In one aspect of the present invention, the deflection means are comprised of a plurality of chambers disposed circumferentially about the distal end of the tool casing. Flexible steel diaphragm serve as the outer surfaces of these chambers. In a highly preferred form, an annular ring chamber is divided into four quadrants wherein each quadrant is hydraulically isolated from the others. Pressurized fluid is admitted selectively to a chamber, distending the diaphragm and bulging it outwardly into contact with the bore hole. Most preferably, pressurized grease is the transmission fluid for creating the deflecting force. Pressure against the bore hole at the distal end of the tool causes a reverse change in orientation at the proximal end of the tool as it proceeds along its path. It will be seen that displacement on the order of $\frac{1}{8}''$–$\frac{1}{4}''$ of the flexible steel diaphragm is sufficient to afford control over the tool under most operating circumstances. In another, alternative aspect of the present invention, an external chamber is provided circumferentially about the distal end of the tool and guide slots milled into the casing for controlling the radial throw of the chamber. In this instance the chamber is segmented into upper and lower, isolated portions. Admitting a pressurized fluid to a segment forces the ring to move in that direction, creating a eflecting force analogous to that described immediately above.

The porting of fluid as required by the path correction means to adjust the course of the tool may be achieved manually or automatically at the desires of the user. The signals developed by the vertical and horizontal position detectors may be utilized to drive controllers in operative association with solenoid valves or similar porting devices. Central processor means may be incorporated whereby the operator can establish a desired course including appropriate grade factors and the control system will then ensure that the path is maintained over many hundreds of feet should that be required.

Other advantages of the present invention, and a fuller appreciation of its construction and mode of operation, will be gained upon an examination of the detailed description of preferred embodiments taken in conjunctions with the figures of drawing.

BRIEF OF THE DRAWINGS

FIG. 1 is a side elevation view of impact type microboring tool having associated therewith a monitor and control system in accordance with the present invention, all shown in simplified form, with the detecting members illustrated in operative association with the distal end of the microboring tool and the path correction member illustrated in phantom lines in a distended position configured for generally upward correction ion of the path of the tool;

FIG. 4 is a partially isometric view of the Hall generator portion of the horizontal position detector of the present invention;

FIG. 5 is a view of a single Hall generator adapted for use in accordance with the present invention, shown here associated with magnetic flux concentrating members;

FIG. 6 is a fragmentary, partially sectional, side elevation view of a path correcting mechanism in accordance with the invention;

FIG. 7 is a sectional view of the deflection mechanism shown in FIG. 6, with a flexible steel diaphragm member illustrated in phantom lines in a distended form for correcting the path of the boring tool;

Figure 3:
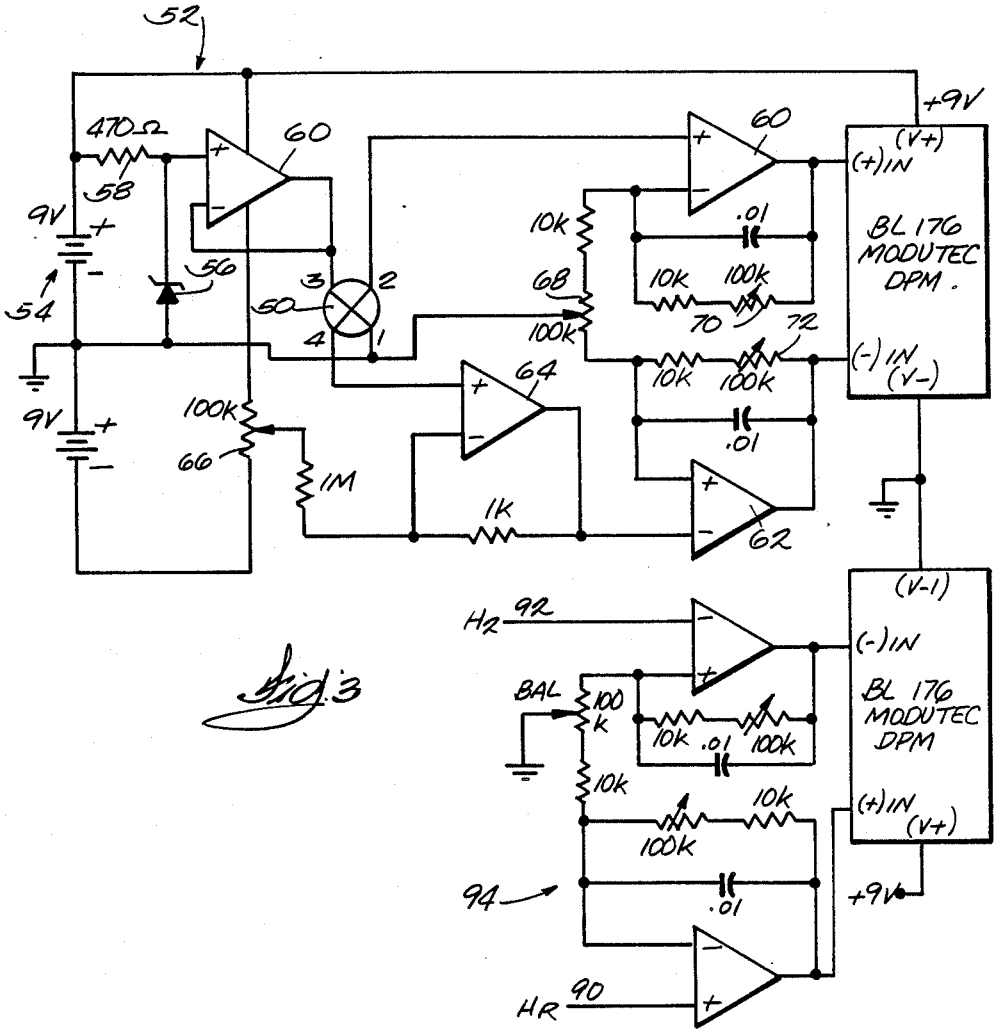
FIG. 3 is a simplified schematic of the electronic circuitry employed to process both vertical and horizontal deviation data and convert the same into operator observable information.

FIG. 8 is view, similar to FIG. 6, but showing an alternative form for a deflection member in accordance with the present invention; and FIG. 9 is a highly diagrammatically illustration of a system in accordance with the present invention, shown in association with a microboring tool which has been inserted from a pit end into the ground and has traversed an earthen path in response to control signals received from an operator panel.

DETAILED DESCRIPTION OF PREFERRED EMBODIMENTS

The present invention relates, generally, to monitoring and control systems for earth boring tools and, more especially, to such systems for use with microboring tools whether of the auger or impact variety. The system generally includes means for monitoring both the vertical and horizontal locations of the tool and for correcting any deviation in the horizontal and/or vertical disposition of that tool relative to a desired path. Accordingly, the invention will now be described with reference to certain preferred embodiments in connection with the foregoing context; albeit, those skilled in the art will appreciate that such a description is meant to be exemplary only and should not be deemed limitative. For example, it will be understood as this description unfolds that the detector members and path correction means may operate independently or interdependently at the desires of the user. Thus, while the system is described with reference to all such components, those of ordinary skill in the art may adapt the system to fewer than the entire assemblage; likewise, the system may be integrated within a much larger whole, but without losing its character. Along these lines therefore, the present invention will be described and defined as a "monitor/control system" to connote the facts that it may comprise a monitor system (and then either vertical or horizontal) or a control system or both.

Turning to the figures of drawing, in each of which like parts are identified with like reference characters, FIG. 1 illustrates in a rather diagrammatic form an earth boring tool into which a control system in accordance with the present invention may advantageously be incorporated. The boring tool, designated generally as 10, is shown to be of the impact type, comprised of generally cyclindrical steel casing 12 having proximal end 14 and a distal end 16, both shown in the illustrative embodiment to be of tapered or generally frustoconical profile with tapers away from the central casing 12 at the ends. The proximal end 14 carries an impact ram 18 projecting therefrom for penetration within the earth upon its reciprocal movement. Reciprocation of the ram 18 is achieved by reciprocating hammer and anvil members disposed interiorly of the tool 10 (not shown) operative by means of compressed air admitted to the tool via air line 20 extending exteriorlyoof the distal end 16. As the ram reciprocates and loosens earth in advance of the moving tool 10, the taper at proximal end 14 of the tool urges the broken soil mixture outwardly and away from the tool, where it is compressed ultimately to form a compacted bore hole 22 through which the tool moves as the bore hole is simultaneously created. The taper of the frustoconical distal end 16 provides some measure of relief at the trailing end of the tool and also provides a more expedious means for withdrawal of the tool simply by reversal of the hammer/anvil orientation, an aspect of the tool unimportant to appreciation of the present invention.

As can be seen from brief reference to FIG. 9, the tool 10 traverses an earthen path 22 emanating from an operation pit 24. For purposes of the instant illustration, let it be assumed that the bore 22 is destined to receive a communication conduit and it is desired by the installer of that conduit that the bore be true both vertically and horizontally over its course. Heretofore that task would have been a relatively simple one where the length of the bore 22 is confined to about 40 feet or less, to the distinct contrary, one of enormous complication where the length of the bore approaches 100 feet or more. The reason is simply due to expected variations in the composition of the soil and its constituents in advance of the tool 10. Although the impact ram 18 is capable of motivating the tool through even shale or other friable subterranean structures, encountering abrupt changes in strata, rocks or the like oftentimes creates a tendency for deviation in the direction or orientation of the tool. Vertical and horizontal position detectors for monitoring the course of the tool 10 are incorporated as components of the overall system of the present invention to sense and report such occurrences to the operator who may then take appropriate action.

With particular reference to FIG. 1, a vertical sensor head, identified generally as 26, and a horizontal detector head, identified generally as 28, are associated in operative engagement with the tool 10 to provide indications of deviation from the desired course, as explained in greater detail hereinbelow. Upon detection of such route departures from the course, a path correction means identified generally as 30 is actuated in order to guide the tool 10 along its desired course. [At this juncture, it should be noted that the term "route" will be used herein to connote the actual path of the tool 10; the term "course" will connote the desired path of the tool.]

Figure 2:
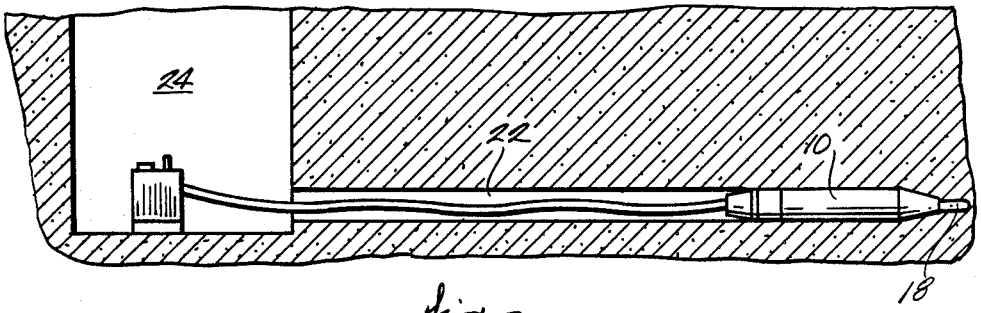
FIG. 2 is a partially sectional view of the sensor head member of the vertical position detector means of the present invention.

The sensor component 26 of the vertical position detector means of the present invention, best viewed in FIG. 2, is preferably comprised of an hermetically sealed housing or chamber 32, shown to be of cylindrical form. For amongst other reasons, it is generally prudent to provide a sealed chamber 32 in order to anticipate operation of the boring tool at or below the water table; preventing the entry of ambient fluid from the bore hole into the sensor head is considered advisable. The cyclinder 32 houses a fluid bellows 34 which acts as a reciprocable piston within the chamber providing a headspace or region 36 above a movable baffle 38 at the end of the bellows 34. Bellows 34 has a tube 40 for admitting fluid to the bladder member or reservoir 42 thereof. As can be seen with reference to FIG. 2, the bellows 34 is of a generally pleated design; thus admission of fluid to the bellows via the tube 40 will create an expansion of bellows member within and along the axis of chamber 32 as the reservoir fills, moving the baffle 38 toward the end of the chamber and thereby decreasing the volume of the headspace 36 therein. The headspace 36 is in fluid isolation from the bellows reservoir 42 and, accordingly, fluid is ported in and out of the headspace 36 via a separate tube 44. It is preferred that the bellows and associated line be charged with a liquid which may be water, but more preferably an oil and most preferably a silicone oil such as that available commercially as Dow Corning #200 silicone oil. Further along these lines, in this particular context it is preferred that the bellows be chosen to be sufficiently sensitive to provide full-scale deflection for pressure differentials across the lines of about 1.5 psi.

The headspace within the chamber 32 is most preferably an air space. Consequently, variations in volume of fluid within reservoir 42 will be manifested as a differential in pressure across the two port lines 40 and 44. Beginning at any realistically arbitrary point of reference, admission of a greater volume of oil to the bellows member moves the baffle 38 toward the end of the cyclinder and thereby reduces the volume of headspace 36. In turn, with a fixed quantity of oil charging the fluid circuit, the pressure differential between the lines 40 and 44 will rise toward the latter; as easily envisioned, a reversal in oil flow, now outwardly of the bellows reservoir, will create a negative differential pressure as measured at line 44 with reference to line 40. [For consistency, differential pressures will be taken at air line 44 relative to oil line 40.]

The port lines 40 and 44 provide fluid communication between the sensor head 26 and a pressure transducer 50 illustrated in FIG. 3. The transducer 50 is responsive to these pressure differentials and, operating in association with pressure sensor means identified generally as 52 in FIG. 3, converts that pressure differential into a measurement of vertical deviation from an established reference line.

Looking more particularly to the vertical sensor circuitry 52 of FIG. 3, the transducer 50 is powered by a regulated supply. Most preferably, the transducer is an MPX 2010DP available from the Semiconductor Products Division of Motorola, Inc., Phoenix, Ariz. The device achieves regulation by controlling a 9-volt DC source 54 across a Zener network comprised of a Zener diode 56 and resistor 58 in operative association with an operational amplifier 60. Given the highly regulated supply, variations in the output of the transducer 50 directly reflect variations in the pressure experienced at sensor head 26, ultimately to be converted into scaled units (e.g., feet/inches) for direct presentation to an operator.

It is well known that the pressure head of a column of fluid is directly proportional to the height of that column. Thus, once the closed fluid system of the vertical detector of the present invention is moved from a reference point at which the system is normalized, the liquid within the bellows side of the circuit will rise or fall as the tool moves downwardly or upwardly, respectively. As noted above, a rising fluid level within the reservoir will port air outwardly of the headspead creating a positive differential pressure on that output line while, conversely, a reduction in the liquid level will cause a negative pressure differential. These changes are sensed by transducer 50 which provides an output at pin 2. The signal from the output of transducer 50 is an elevational output signal proportional to vertical deviation in the route of the tool from the intended course, and it is applied to the positive input of operational amplifier 60. Working in conjunction with an operational amplifier 62, the network functions as a comparator circuit, in this instance illustrated as a standard instrumentation op amp circuit comprised of the tandem amplifiers. The circuit is nulled by means of op amp 64 and variable resistor 66. Balancing of the amplifiers is achieved by variable resistor 68 while individual fine tuning to maintain zero and linearity may be achieved by variable resistors 70 and 72 associated with amplifiers 60 and 62 respectively. The elevation output signal developed by transducer 50 is applied to the plus input of the operational amplifier 64 the output thereof constitutes a plus input to a display panel meter, in this instance shown to be a BL 176 DPM available from Modutec of Norwalk, Conn. Given the representative value for circuit components in FIG. 3, the op amp circuitry comprised of amplifiers 60 and 62 will provide a gain of about 8, while the gain of the DPM itself is approximately 10. Under most circumstances this is entirely adequate for conventional earth boring utility. Appropriately zeroing the circuit at a reference point and scaling the signals allows the operator to read vertical deviations of the boring tool directly on the panel meter to an accuracy on the order of 0.1 inches. Reliability of the circuit is high, the use of chopper stabilized operational amplifiers being particularly preferred. In this regard, most preferably the circuit incorporates Maxim 423 operational amplifiers available from Maxim Integrated Products, Inc. of Sunnyvale, Calif.

The control system of the present invention further includes a horizontal position detector for monitoring any deviation of the tool 10 left or right from a predetermined course through the bore hole 22. In this case a horizontal sensor 28 is operatively associated proximate the distal end 16 of the boring tool 10. The sensor 28, best viewed in isolation in FIG. 4, is most preferably a magnetic resolver means capable of discriminating vectorially magnetic flux density and/or gradient in a localized field and ideally is comprised of Hall generators 80 and 82. Hall generators are aptly named for making use of the Hall effect, adapting the discovery that a magnetic field skews the equipotential lines in a conductor creating an induced voltage perpendicular to the direction of current in that conductor. If a flat current-carrying conductor is placed in a magnetic field, the moving current charges (e.g., electrons) experience a net force mutually perpendicular to the direction of the current flow in the magnetic field due to the field energy. This force creates an accumulation of charge carriers along one edge of the conductor while oppositely charged carriers tend to gather on the other side creating an uneven lateral charge distribution, in turn creating an electric field which is measurable as a so-called Hall voltage derivable as the vector product of charge and flux. Hall generators 80 and 82 take advantage of that phenomenon as well as the uniformity of the magnetic field at the earth's surface.

As best viewed in FIG. 4, the Hall generators 80 and 82 are oriented at approximately 90 degrees one to another, shown here generally oriented in a truncated "V" disposition with the (imaginary) apex pointing in the direction of movement of the tool 10 generally along the longitudinal axis thereof. A constant current DC source supplies regulated current for series flow through the two Hall generators 80 and 82. Current flows from a line 84 into the first Hall generator 80 and therethrough, via a line 86 to the second Hall generator 82 and once again therethrough, ultimately returning to the source via line 88. As that current flows through the Hall generators, a charge imbalance is created due to the presence of the ambient magnetic field proximate the sensor 28 (the lines of flux thereof omitted from the figures of drawing for the sake of clarity). The polarity of the individual outputs of the Hall generators may be selected at will by the designer insofar as the constancy of the current flow and magnetic force allows one simply to turn the Hall generator to invert its polarity (since the device is responsive to the vector products of flux and charge flow). In order to maximize spatial discrimination for purposes of the present invention, the two Hall generators are oriented electromagnetically 180 degrees out of phase to reinforce rather than cancel the Hall voltage outputs.

The output of the magnetic resolver or sensor 28 is picked up from lines 90 and 92 as shown in FIG. 4, representing deviations in respect of right and left movement, respectively. These signals are applied to a magnetic comparator circuit 94 illustrated in FIG. 3. Comparing the circuitry of the magnetic comparator in the lower portion FIG. 3 with that for the pressure comparator circuitry in the upper portion thereof, it will be noticed immediately that the same are generally identical in terms of the instrumentation op amp configuration, and thus detailed description is omitted here. The operational amplifiers provide driving outputs to a second digital panel meter showing deviations in degree of arc left and right from a predetermined reference setting. Utilizing a preferred Hall generator available as Model BH-850 from the F. W. Bell Company of Orlando, Fla., it has been determined that a degree of accuracy of approximately one minute of arc is achievable; thus, a deviation of approximately $\frac{3}{8}$ over a distance of about 100 feet is detectable.

In instances where the casing of the tool 10 is highly permeable to magnetic flux, the Hall generators 80 and 82 may be affixed directly to the casing and the latter function as a flux concentrator. For example, slots may be milled, and the generally flat chip epoxied directly, into the casing. In other instances the casing may not be made from a highly permeable material, and then magnetic flux concentrators, such as those illustrated in FIG. 5 in the form of ferrite rods 98 and 100, are associated with each of the Hall generators 80 and 82. For the sake of clarity, only the generator 80 is shown in FIG. 5, it being recognized that similar ferrite rods would be associated with the Hall generator 82. These ferrite rods serve to intensify the effects of the magnetic field, focusing the magnetic field energy and thereby improving the receptivity of the Hall generators. Otherwise, the operation of the horizontal position detector is the same as expressed above.

Having developed signals representative of vertical and horizontal deviations of the tool 10, both plus and minus from a predetermined course, the operator may profitably use this information to guide the tool back to that desirable path should it have deviated therefrom. For this purpose a path correction means 30 is associated with the tool 10 as described above with reference to FIG. 1. FIGS. 6 and 7 show a highly preferred form for that path convection means. In this case an annular chamber is divided into four quadrants identified 102, 104, 106 and 108, these being isolated one from another. Each of the quadrant chambers is likewise divided into four segments, these identified as 110 in the illustrated embodiment. The segments 110 are formed by ribs 112 which serve to segment each of the major quadrants 102–108. Each chamber is provided with a cover member of a relatively thin, flexible steel sheet 114, the ribs 112 thus providing some lateral reinforcement of the sheet to guard against crushing forces when the tool 10 is in use. Preferably the steel cover member is on the order of about 0.025" (25 mils.) and, upon suitable application of pressure, will function as a diaphragm as best envisioned with reference to the phantom illustration in FIGS. 6 and 7. In order to achieve that configuration, each of the quadrants, and preferably each of the individual segments thereof, is ported to received pressurized fluid. Main ports 116 communicate with four separate fluid lines 118 trailing from the distal end of the tool 10. The passages 116 provide fluid to the individual segments 110 via lines 120 best viewed in FIG. 7. In this manner an individual diaphragm 114 may be isolated for operation, which is achieved by conducting fluid under pressure through an appropriate one of the lines 118 and porting it internally to the chamber of interest (such as chamber 108 as shown in the figures of drawing) in order to deflect that diaphragm member outwardly. The outward deflection of the diaphragm member causes a resultant deflecting force on the sidewall of the bore hole through which the tool is passing. This deflecting force need not be of substantial amplitude since correction is made generally as deviation is observed; in other words, the objective is to avoid allowing the tool to deviate substantially from its path, making continual corrections to maintain its path thereby reducing the magnitude of deflecting force required to do so. Typically, deflection of the diaphragm 114 on the order of $\frac{1}{8}$"–$\frac{1}{4}$" will be ample for purposes of control.

FIG. 8 illustrates an alternate embodiment for a path correcting device wherein a chamber is disposed circumferentially about the casing 12, in this case divided into an upper section 122 and a lower section 124. The correction member is in the form of a sleeve having circumferential arms 126 and lateral faces 128. The upper and lower channel members 122 and 124 are isolated by a dividing member 130. The framework 126–128 constituting the overall configuration of the path correcting member is approximately equal to the diameter of the tool 10. However, slots 132 are milled or otherwise formed within the casing to permit radial deflection of the framework. Pressurized fluid is ported within a selected one of the chambers 122 or 124 via lines 134 and 136 respectively. Because of the displacement allowed by the milled slots, admission of pressurized fluid to one or the other of the chambers will cause radial displacement of the entire mechanism in that direction, the slots and cooperative frame limiting the throw of the deflecting member. analogous to the embodiment described above, admission of pressurized fluid to chamber 122 via line 134 will cause an upward deflection of the frame as shown in phantom lines in FIG. 8, creating a deflecting force along the upper lateral face 128 as it is urged into proximate engagement with the wall of the bore hole. Just as the deflection of the diagram 114 with reference to the embodiment of FIGS. 6 and 7 created an adjusting force altering the course of the tool, so too does the radial movement of the path correcting member of FIG. 8 caused that selfsame result.

The fluid ported to the path correction mechanism, whether it be of the embodiment shown in FIG. 6 or that of FIG. 8, is most preferably pressurized grease. Pressures on the order of about 10,000 psi may be achieved but without requirements of large quantities of fluid due to the highly incompressible nature of grease.

In operation, the monitoring and control system of the present invention is both simple and efficient. The bore tool 10 is located initially within the pit 24 and positioned within a precursor bore hole in order to stabilize the device at a reference point. Fluid within the sensor 26 will seek an equilibrium position with the baffle 38 at a static location. Pressure in the lines 40 and 44 being stabilized, the operator may adjust the circuitry 52 to establish a zero reference point indicative of that vertical location of the tool. Likewise, the magnetic resolver 28 will be in a quesicent state with current flowing through the Hall generators and a Hall voltage developed proportional to the combined influence of that current and the ambient magnetic field representative of the static horizontal position of the tool. The circuitry 94 which responds to the Hall voltage may be normalized with reference to that condition.

With the system initialized as aforesaid, the operator may then begin the procedure of boring by admitting pressurized air via line 20 to the hammer/anvil components of the impact mechanism. As the ram 18 reciprocates the tool is motivated forwardly as best envisioned with reference to FIG. 9. Let it be assumed that at some distance from the pit the tool encounters an obstruction which tends to pitch it upwardly and to the right relative to the desired path of the bore hole 22.

As the tool 10 rises the fluid within reservoir 42 of the bellows 34 evacuates slightly, moving the baffle 38 toward the floor of the chamber 32 and increasing the air space 36. A negative pressure differential is established across the lines 44 and 40. The change in line pressure is detected by the transducer 50 which creates a voltage output proportional to the pressure differential. In this instance, the negative pressure differential at line 44 (vis-a-vis line 40) is sensed as an upward deviation of the tool 10 from the desired path. A signal characteristic of that change is applied to the input of operational amplifier 60 acting in tandem with amplifier 62. Together, the network outputs to the DPM a signal which is converted and applied to an appropriately scaled display showing the operator the upward change in the direction of the tool 10.

As the tool 10 is also moved to the right upon encountering the obstruction, the magnetic resolver or sensor 28 is subjected to a change in orientation relative to the magnetic flux of the earth's magnetic field. This will cause a change in the output Hall voltage from the two Hall generators 80 and 82. Due to the phase relationship of the two generators, the output signals will reinforce as oppose to cancel. The changes in Hall voltages at lines 90 and 92 are applied to the operational amplifier network 94 of FIG. 3. Those signals are processed and applied to the DPM associated with the Hall circuitry and the operator is once again presented with a visual indication of the deviation of the tool.

Monitoring the two displays, the operator will observe in real time the indications of movement of the tool 10 from its desired course; in this example, upwardly and to the right. Correction is made by operator manipulation of a source of pressurized fluid, most preferably pressurized grease. Selection of appropriate lines 118 will admit grease to the path correction member 30, such as the one illustrated in FIGS. 6 and 7, to create an outward bulging of the associated diaphragm 114. Insofar as the correction member is located at the distal end of the tool, correction is made in a generally mirror image relationship relative to the direction the operator desires the tool to assume. In other words, to cause the tool to move downwardly and correct that component of it deviant path, the operator will supply grease to an upper quadrant chamber; likewise, movement to the left to resume the desired path necessitates operation of a diaphragm on the right side of the tool. With the ability to monitor the movement of the tool as these correcting forces are applied, operator familiarly with the control aspect of the device is achieved quite readily.

As is readily apparent from the foregoing description, the monitor/control system of the present invention simply yet efficiently provides real time information to the boring tool operator respecting both vertical and horizontal location of the tool at all times. Correction is achievable either by operator interaction with the system via the control lines mentioned above or the system may readily be adapted to automated correction in which the output signals to the panel displays also function as inputs to adaptive controllers porting pressurized fluid as need be to maintain the tool on course. Because of the direct feedback between monitor and control functions, the course of the moving boring tool may be maintained very accurately. This allows a tool equipped with the monitor/control system of the present invention to function efficiently over long courses, such as those of several hundreds of feet. The tool is thus made more reliable for the laying of cables and pipes beneath a roadway, obviating the need to engage in ground level excavation save a pit to initiate the bore and one to retrieve the tool, excavation which in any event would have been necessitated by the construction project at hand. The monitor/control system of the present invention indirectly facilitates great advances in the tunneling art as well. A microboring tool such as that disclosed in detail above may be made to follow an exacting and highly precise path, forming a bore hole to serve as a pilot for a larger tunneling tool. Insofar as the costs associated with fabrication of a microboring tool equipped with a system in accordance with the present invention are considerably less than the costs currently expended by those engaged in tunneling in order to control the route of the tunneling apparatus, this adaptation of the present invention fills a need long felt by those in this industry.

While the invention has now been described with reference to certain preferred embodiments and detailed in many aspects with regard to suggested circuitry or components therefor, those skilled in the art will appreciate that various substitutions, modifications, changes and omissions may be made without departing from the spirit thereof. Accordingly, the foregoing description is meant to be exemplary and should not be deemed limitative on the scope of the following claims.

What is claimed is:

1. A monitor/control system for an earth boring tool to determine the spatial orientation of said tool at a remote location and to adjust the path thereof to maintain a predetermined course, said system comprising:

(a) vertical position detector means for ascertaining the elevation of a moving boring tool relative to a desired course, including a sensor head for operative engagement with said tool, pressure sensor means for developing a signal representative of a pressure differential existing at said sensor head, and a closed fluid circuit communicating between said sensor head and said sensor means;

(b) horizontal position detector means for ascertaining the azimuth of said tool relative to said course, including magnetic resolver means in operative engagement with said tool for developing a signal representative of a localized flux differential in an ambient magnetic field; and, (c) path correction means secured to said tool for adjusting its route relative to said course, including deflection means for bearing against the bore hole created by said moving tool.

2. A monitor/control system for an earth boring tool to determine the spatial orientation of said tool at a remote location, comprising a vertical position detector means for ascertaining the elevation of said tool relative to a desired course, including a sensor head for operative engagement with said tool, pressure sensor means for developing a signal representing of a pressure differential existing at said sensor head, and a closed fluid circuit communicating between said sensor head and said sensor means.

3. A monitor/control system for an earth boring tool to determine the spatial orientation of said tool at a remote location, comprising a horizontal position detector means for ascertaining the azimuth of said tool relative to a desired course, including magnetic resolver means comprised of at least one Hall generator means for operative engagement with said tool for developing a signal representative of a localized flux differential in an ambient magnetic field characteristic of the earth's magnetic field.

4. The monitor/control system of claim 1, wherein said magnetic resolver means is comprised of at least one Hall generator means.

5. A monitor/control system for an earth boring tool to adjust the path thereof to maintain a predetermined course, comprising hydraulically actuated deflection means including diaphragm means for bearing against the bore hole created by said tool; wherein said deflection means comprises a multisegment isolated chamber means ported for individual admission of pressurized fluid selectively to one or more of said chambers and flexible diaphragms comprising covers for each of said chambers, whereby said diaphragms are outwardly extensible into contact with said bore hole upon charging a sected chamber means with said pressurized fluid.

6. The monitor/control system of claims 1 or 2, wherein said sensor head is comprised of separation means for dividing said fluid circuit into first and second, isolated fluid legs.

7. The monitor/control system of claim 6, wherein said separation means is comprised of a chamber housing a flexible fluid bellows defining a headspace above said bellows, and first and second ports separately, respectively communicating with said bellows and said head space.

8. The monitor/control system of claim 7, wherein said fluid circuit is comprised of first and second tubing members in fluid communication with said first and second ports, respectively.

9. The monitor/control system of claim 8, wherein said bellows lies in said first fluid leg and said headspace lies in said second fluid leg, and further wherein said first fluid leg is a liquid leg and said second fluid leg is a gas leg.

10. The monitor/control system of claim 9, wherein said liquid is oil and said gas is air.

11. The monitor/control system of claim 6, wherein said pressure sensor means is a pressure transducer means for detecting pressure variations between said first and second fluid legs and developing an elevation output signal proportional thereto.

12. The monitor/control system of claim 11, further comprising scaling and display means for converting said elevation output signal into a vertical deviation signal and presenting the same for operator observation.

13. The monitor/control system of claims 1, 3 or 4, wherein said magnetic resolver means is comprised of a pair of Hall generators disposed geometrically at about 90° and electromagnetically 180° out of phase.

14. The monitor/control system of claim 13, wherein said Hall generators are disposed along opposite legs in a generally truncated "V"-shaped geometry, with the apex of the "V" lying generally in the direction of movement of said tool.

15. The monitor/control system of claim 14, wherein said Hall generators are disposed electrically in series current flow relationship, said system further comprising a constant current source for supplying operational current to said generators and output means from said resolver providing an azimuthal output signal proportional to any magnetic flux differential experienced by said Hall generators.

16. The monitor/control system of claim 14, further comprising scaling and display means for converting said azimuthal output signal into an azimuthal deviation signal and presenting the same for operator observation.

17. The monitor/control system of claims 1 or 5., wherein said deflection means comprises a multisegment isolated chamber means ported for individual admission of pressurized fluid selectively to one or more of said chambers and flexible diaphragms comprising covers for each of said chambers, whereby said diaphragms are outwardly extensible into contact with said bore hole upon charging a selected chamber means with said pressurized fluid.

18. The monitor/control system of claims 5 or 17 wherein said multisegment chamber is a four quadrant chamber.

19. The monitor/control system of claims 5 or 17, further comprising a source of grease and pressurizing means therefor, in fluid communication with said deflection means.

* * * * *